US008157542B2

(12) United States Patent
Boutros

(10) Patent No.: US 8,157,542 B2
(45) Date of Patent: Apr. 17, 2012

(54) BRUSHLESS MOTOR FUEL PUMP WITH CONTROL ELECTRONICS ARRANGEMENT

(75) Inventor: Matthias Boutros, Neuss (DE)

(73) Assignee: TI Automotive (Neuss) GmbH, Neuss (DE)

( * ) Notice: Subject to any disclaimer, the term of this patent is extended or adjusted under 35 U.S.C. 154(b) by 335 days.

(21) Appl. No.: 12/139,002

(22) Filed: Jun. 13, 2008

(65) Prior Publication Data

US 2008/0310976 A1 Dec. 18, 2008

(30) Foreign Application Priority Data

Jun. 15, 2007 (DE) ..... 10 2007 028 398

(51) Int. Cl.
*F04B 39/06* (2006.01)

(52) U.S. Cl. ..... 417/366; 417/410.1

(58) Field of Classification Search ..... 417/366, 417/410.1, 423.3, 423.7, 423.9, 313
See application file for complete search history.

(56) References Cited

U.S. PATENT DOCUMENTS

| | | | | |
|---|---|---|---|---|
| 4,726,746 | A * | 2/1988 | Takada et al. | 417/423.1 |
| 4,904,162 | A * | 2/1990 | Suzuki et al. | 417/44.4 |
| 4,998,865 | A * | 3/1991 | Nakanishi et al. | 417/423.7 |
| 5,036,822 | A * | 8/1991 | Kojima | 123/509 |
| 5,120,201 | A * | 6/1992 | Tuckey et al. | 417/366 |
| 5,156,535 | A * | 10/1992 | Budris et al. | 417/423.7 |
| 5,356,272 | A * | 10/1994 | Nagata et al. | 417/366 |
| 5,360,322 | A * | 11/1994 | Henein et al. | 417/313 |
| 5,456,235 | A * | 10/1995 | Porter | 123/509 |
| 5,613,844 | A * | 3/1997 | Tuckey et al. | 417/366 |
| 5,860,796 | A * | 1/1999 | Clausen | 417/423.9 |
| 6,159,383 | A | 12/2000 | Gullett et al. | |
| 6,293,770 | B1 * | 9/2001 | Matsumoto et al. | 417/361 |
| 6,358,022 | B1 * | 3/2002 | Frank et al. | 417/423.9 |
| 6,753,629 | B2 * | 6/2004 | Doi et al. | 310/68 D |
| 6,877,488 | B2 * | 4/2005 | Washeleski et al. | 123/497 |
| 6,887,388 | B2 * | 5/2005 | Winn et al. | 210/739 |
| 6,918,380 | B2 * | 7/2005 | Nomura | 123/495 |
| 6,986,650 | B2 * | 1/2006 | West | 417/423.3 |
| 2001/0018908 | A1 | 9/2001 | Joos et al. | |
| 2001/0051098 | A1 | 12/2001 | Kenney et al. | |
| 2004/0028539 | A1 * | 2/2004 | Williams et al. | 417/366 |
| 2006/0275163 | A1 * | 12/2006 | Pike | 417/423.9 |
| 2006/0279162 | A1 | 12/2006 | Achor et al. | |

FOREIGN PATENT DOCUMENTS

| | | |
|---|---|---|
| EP | 0423636 | 7/1996 |
| EP | 1186772 | 3/2002 |
| GB | 2378222 | 2/2003 |

* cited by examiner

*Primary Examiner* — Charles Freay
*Assistant Examiner* — Nathan Zollinger
(74) *Attorney, Agent, or Firm* — Reising Ethington P.C.

(57) ABSTRACT

The invention relates to a fuel conveying device for conveying fuel towards an internal combustion engine. The fuel conveying device comprises a housing and a head connected to the housing. Further, a fuel pump is provided, having an electronically commutated brushless motor. The control electronics for the electronically commutated brushless motor of the fuel pump are carried by or arranged within and/or on the head or housing.

6 Claims, 1 Drawing Sheet

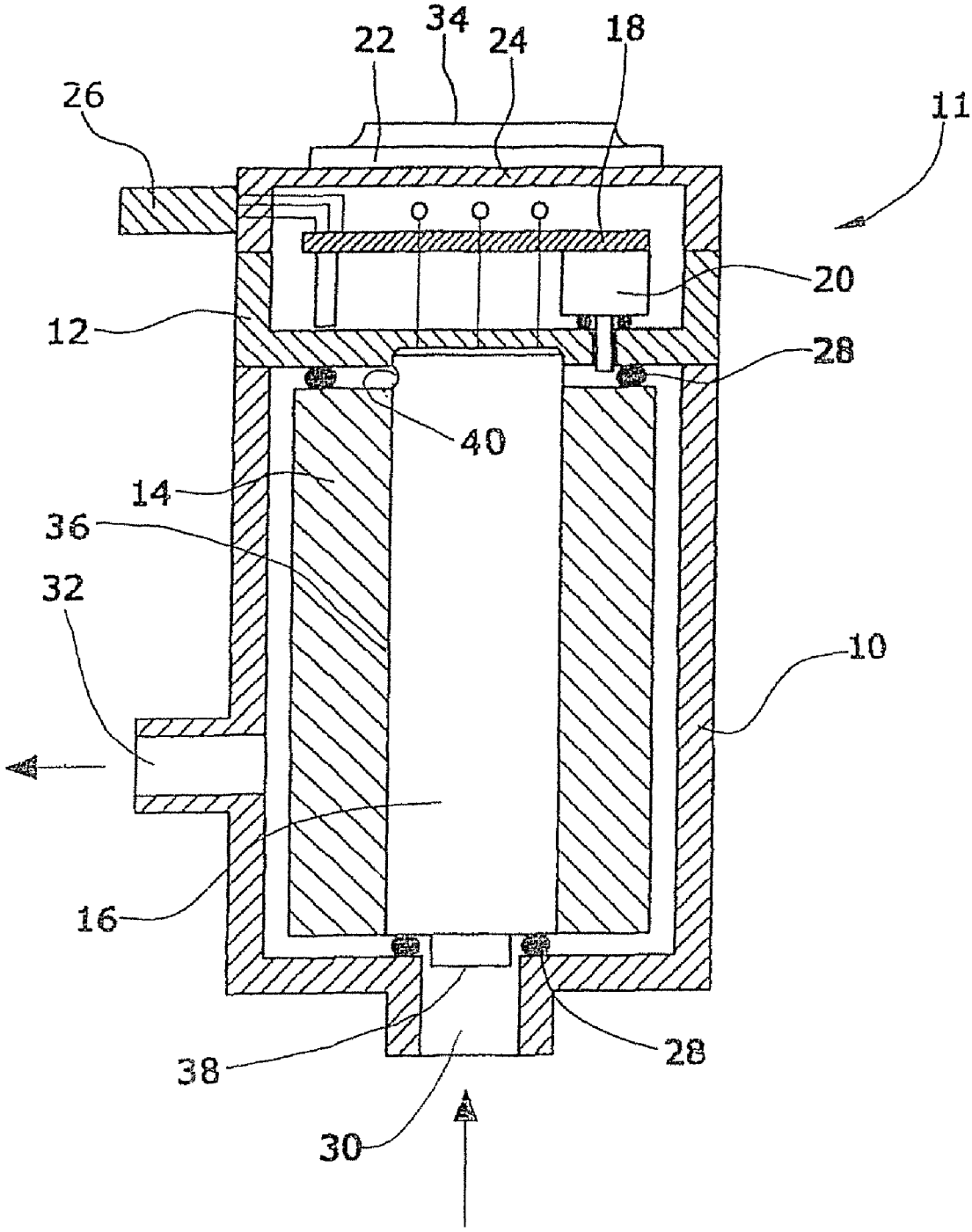
34
22
24
18
26
11
20
12
28
40
14
36
32
10
16
38
28
30

BRUSHLESS MOTOR FUEL PUMP WITH CONTROL ELECTRONICS ARRANGEMENT

REFERENCE TO COPENDING APPLICATION

This application claims priority to German Patent Application No. 10 2007 028 398.0 filed Jun. 15, 2007, the contents of which are hereby incorporated by reference.

FIELD OF THE INVENTION

The present invention relates generally to a fuel pump for conveying fuel to an engine, and more particularly to a brushless motor fuel pump.

BACKGROUND OF THE INVENTION

For the conveying of fuel to an internal combustion engine, a large variety of fuel pumps are known. The provision of control electronics externally of the pump housing increases material cost, manufacturing cost and the size of the fuel pump assembly. Further, electrical losses are caused by the long line paths from the pump to the external control unit. Also, contact problems may occur at the electrical connection to the fuel pump, increasing the risk of pump failure. This may occur, for example, due to vibrations and/or exposure to volatile fuel.

SUMMARY OF THE INVENTION

A fuel conveying device includes a housing, a head connected to the housing, and a pump driven by an electronically commutated brushless motor. The pump is preferably arranged within a fuel filter which in turn can be accommodated in the housing. The housing can be closed, e.g. one end such as at its upper end, by the head.

Control electronics for the electronically commutated brushless motor of the fuel pump may be arranged within and/or on the head. In one form, the control electronics can be accommodated wholly within the head. The control electronics can also be arranged wholly externally of the head but, at the same time, immediately at the head. A combination of these two variants is possible, too.

BRIEF DESCRIPTION OF THE DRAWINGS

The following detailed description of preferred embodiments and best mode will be set forth with reference to FIG. 1 which shows a schematic view of one implementation of a fuel pump.

DETAILED DESCRIPTION OF PREFERRED EMBODIMENTS

A fuel conveying device 11 for conveying fuel to an internal combustion engine (not shown) comprises a filter housing 10, a cap or filter head 12 and a fuel filter 14. A fuel pump 16 provided with an electronically commutated brushless motor (not shown) is arranged within fuel filter 14 which may be annular. Filter housing 10 is formed with a fuel inlet 30 for intake of fuel by the fuel pump 16. Further provided is a fuel outlet 32 for conveying fuel under pressure from the fuel pump 16 towards the internal combustion engine. Filter head 12 can be provided, e.g., with a board having arranged thereon control electronics 18 for the electronically commutated brushless motor of the fuel pump 16. Optionally, said board can also have arranged thereon or otherwise carried by or on the board or head 12 an electronic pressure sensor 20 for pressure control of fuel pump 16. Alternatively, pressure control can be performed mechanically by use of a mechanical pressure regulator, control device or assembly. Electrical power may be provided to the fuel conveying device through an electrical connector 26, which may also receive or pass therethrough wires associated with one or more sensors or electronic controllers.

To improve the thermal conductivity of the fuel conveying device, filter head 12 can be formed from a metallic material. By way of alternative or in addition thereto, a cooling body 22 can be provided. The cooling body can be mounted, e.g., on a lid 24 fastened to the filter head 12.

To reduce or prevent leakage, seals 28, preferably in the form of O-rings, can be provided, e.g. above and below the fuel pump. The seals 28 can be arranged between fuel pump 16 and filter housing 10, or between fuel filter 14 and filter housing 10 and/or filter head 12.

In at least some implementations, no additional electronic components in the form of a control unit may be needed for the operation of the fuel conveying device 11. Further, the operation of pressure sensor 20 will not require separate electric plugs or housings.

In implementations where the control electronics 18 for the electronically commutated brushless motor are accommodated internally of the head 12 or between the head 12 and lid 24, less material is required for the fuel conveying device, which may result in a more straightforward and less expensive design. Further, electrical losses or interference caused by long line paths from the fuel pump 16 to the control electronics 18 will be reduced and may be avoided altogether.

The risk of failure of the fuel conveying device 11 can be reduced also because the need for an external connection of the fuel pump 16 to the control electronics 18 is obviated. The required size or volume of the fuel conveying device 11 can be reduced as well because the control electronics 18 do not need a separate housing. The use of a brushless motor allows for a more-robust construction which in turn will allow for a reliable operation of the fuel conveying device 11.

As one alternative, the fuel filter 14 can be arranged upstream or downstream of the fuel pump 16 externally of a pump housing or casing. In this example, the pump 16 may be formed as a self-contained subassembly including a motor and a pump element or elements enclosed within a casing 36 having appropriate fuel inlet and outlet ports 38 and 40 respectively for fuel conveyance. As shown, the fuel filter 14 may be arranged around at least a portion of the periphery of the pump, so that the pump 16 and filter 14 are contained within the same housing 10 including the same cap or head, and may include a lid.

The control electronics 18, particularly for controlling the rotational speed of the electronically commutated brushless motor, may be carried by one or both of the head 12 and housing 10, and for example, may be arranged in and/or on the cap or head 12. In one implementation, the electronic pressure sensor 20 for pressure control of the fuel pump 16 can be are arranged within and/or on the filter head 12. The pressure sensor 20 may include a sensing element communicated with fuel at pump outlet pressure, such as through a port opening into the filter housing at a location downstream of the fuel pump outlet.

All of the above mentioned electronic components can be provided e.g. on a board within and/or at the filter head. The control electronics 18 in the filter head 12 can be provided e.g. in the form of an electronic circuit adapted to drive the stator of the electronically commutated motor. The driving can be performed in dependence on the rotor position which is measured by a suitable device such as, e.g., Hall effect sensors.

For improving the thermal behavior, the filter head 12 may be formed in whole or in part from a material of high thermal conductivity, e.g. a metallic material. The material of the filter head 12 may have a thermal conductivity above 100 W/mK and, more preferably, a thermal conductivity above 200 W/mK. Examples of preferred materials are zinc die casting with a thermal conductivity of about 115 W/mK or aluminum with a thermal conductivity of about 237 W/mK. Additionally or by way of alternative thereto, the filter head 12 can include a cooling body 22 provided, e.g. with cooling ribs or fins 34 or with a cooling surface area enlarged in another manner. A plastic material may also be used, for example, in cases where a high thermal conductivity of the filter head is not required, because the components to be cooled generate little waste heat. The plastic material may be PA6.6 (melt) having a thermal conductivity of about 0.28 W/mK, for example.

For further enhancement of the thermal behavior, the control electronics 18 may be connected to the filter head 12 in a manner allowing for good thermal conductivity. For this purpose, the control electronics 18 can be formed, e.g. as a board comprising a large contact surface to the filter head 12.

Although the invention has been describe and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A fuel conveying device for conveying fuel to an engine, comprising:

a filter housing having a fuel inlet and a fuel outlet;

a metal cap attached to the filter housing wherein the metal cap is made of a material having a high thermal conductivity of at least about 100 W/mk;

a lid attached to the metal cap, the lid having at least one cooling fin which has a cooling surface exposed to an exterior of the filter housing;

an annular fuel filter disposed wholly within the filter housing;

a casing received within the filter housing, the casing enclosing an electronically commutated brushless motor and a fuel pump, the casing also having a fuel inlet port and a fuel outlet port, the fuel inlet port communicating with the fuel inlet of the filter housing, wherein fuel passes into the fuel inlet port before passing through the annular fuel filter; and control electronics for the electronically commutated brushless motor received within the metal cap in direct conductive heat transfer relationship with the at least one cooling fin, wherein the control electronics are enclosed at least in part by the metal cap to isolate the control electronics from exposure to fuel.

2. The fuel conveying device of claim 1 wherein the control electronics controls the rotational speed of the electronically commutated brushless motor driving the fuel pump.

3. The fuel conveying device of claim 1 which also comprises an electronic pressure sensor for sensing the pressure of fuel supplied by the operating fuel pump and electrically connected with the control electronics for controlling the rotational speed of the brushless motor driving the fuel pump.

4. The fuel conveying device of claim 1 wherein the material of the cap comprises zinc or aluminum.

5. The fuel conveying device of claim 1 wherein the control electronics comprises a board which engages the cap so that heat is conducted from the board to the cap.

6. The fuel conveying device of claim 1 wherein the cap is in fluid communication with the fuel outlet port of the casing of the brushless motor and fuel pump assembly.

* * * * *